US005404819A

United States Patent [19]

Hishinuma et al.

[11] Patent Number: 5,404,819

[45] Date of Patent: Apr. 11, 1995

[54] APPARATUS FOR CLEANING PRINTING PRESS BLANKET CYLINDER AND METHOD FOR MANUFACTURING THE SAME

[75] Inventors: Toru Hishinuma, Kumagaya; Hideyuki Yamamoto, Tokyo, both of Japan

[73] Assignee: Nikka Limited, Tokyo, Japan

[21] Appl. No.: 283,168

[22] Filed: Aug. 3, 1994

[30] Foreign Application Priority Data

Aug. 4, 1993 [JP] Japan ..... 5-193747
Dec. 27, 1993 [JP] Japan ..... 5-332190

[51] Int. Cl.[6] ..... B41F 35/06; B41L 41/06

[52] U.S. Cl. ..... 101/425; 101/423; 15/256.51

[58] Field of Search ..... 101/416.1, 423, 425; 15/256.5, 256.51

[56] References Cited

U.S. PATENT DOCUMENTS 4,344,361 8/1982 MacPhee et al. ..... 101/425
4,537,130 8/1985 Theilacker ..... 101/425
5,012,739 5/1991 Loos et al. ..... 101/425
5,040,462 8/1991 Hillenbrand et al. .
5,068,225 11/1991 Pennell et al. ..... 514/57
5,069,128 12/1991 Hara et al. ..... 101/425
5,181,914 1/1993 Zook ..... 604/307

FOREIGN PATENT DOCUMENTS 0445600 9/1991 European Pat. Off. .
2-6629 2/1990 Japan .
4-44370 10/1992 Japan .

*Primary Examiner*—Edgar S. Burr
*Assistant Examiner*—Lynn D. Hendrickson
*Attorney, Agent, or Firm*—Wenderoth, Lind & Ponack

[57] ABSTRACT

A blanket cylinder cleaning apparatus includes a pressure pad for pressing a cleaning fabric against a rotating blanket cylinder in a printing press to wipe away unwanted matter such as residual ink on the peripheral surface of the blanket cylinder. The pressure pad is hollow and filled with gelatinous viscoelastic material to stably bring the cleaning fabric into adequate contact with the blanket cylinder to efficiently clean the blanket cylinder. The viscoelastic material is solated with heat and readily injected into the inside space of the pressure pad.

14 Claims, 5 Drawing Sheets

APPARATUS FOR CLEANING PRINTING PRESS BLANKET CYLINDER AND METHOD FOR MANUFACTURING THE SAME

BACKGROUND OF THE INVENTION

1. Field of the Invention

This invention relates to an apparatus for removing unwanted matter such as residue ink from a blanket cylinder in a printing press, and more particularly, to a blanket cylinder cleaning apparatus having a pressure pad capable of pressing a cleaning fabric against the outer peripheral surface of the printing press blanket cylinder to effectively wipe the unwanted matter from the blanket cylinder.

2. Description of the Prior Art

A blanket cylinder in an offset printing press is commonly accompanied by a blanket cylinder cleaning apparatus to wipe unwanted matter such as residual ink and paper fragments from the outer peripheral surface of the blanket cylinder by pressing a cleaning fabric against the rotating blanket cylinder. In general, to heighten the effect of cleaning the blanket cylinder, the blanket cylinder cleaning apparatus has a washer for spraying a washing solution such as an ink solvent or water on the blanket cylinder.

In a blanket cylinder cleaner described in U.S. Pat. No. 4,344,361 to MacPhee et al. (corresponding to Japanese Patent Publication No. HEI 2-6629(B)), a cleaning fabric is brought into press contact with a rotating blanket cylinder to clean the cylindrical surface of the blanket cylinder.

To be more specific, as shown in FIG. 1, the blanket cylinder cleaner of this type comprises a fabric supply roll 4*a* and a fabric take-up roll 4*b* so that the cleaning fabric 2 unwound from the supply roll 4*a* is taken up by the fabric roll 4*b*. The cleaning fabric 2 traveling between the rolls 4*a* and 4*b* comes into contact with the blanket cylinder C while being pressed against the blanket cylinder C by a pressure pad 6. The blanket cylinder cleaner is arranged in parallel to the blanket cylinder C so as to bring the entire length of the cleaner into press contact with the blanket cylinder C as illustrated. The fabric rolls 4*a* and 4*b* rotate in the same direction as the blanket cylinder C, so that the contact surfaces of the cleaning fabric 2 and the blanket cylinder C relatively move in opposite directions so as to wipe off residual ink adhering to the blanket cylinder C with the cleaning fabric 2.

The pressure pad disposed in the conventional cleaning apparatus of this type has been formed by curving a rubber plate in the shape of a semi-columnar cylinder or made of a rubber tube (as proposed by Japanese Utility Model Publication No. HEI 4-44370(B)), and retained by a supporting member so as to press the cleaning fabric against the blanket cylinder.

The blanket cylinder cleaner in the afore noted U.S. Pat. No. 4,344,361 is provided on the supporting member for the pressure pad with an air supply path capable of supplying air into the inside space within the pressure pad so as to inflate or deflate the pressure pad for permitting the cleaning fabric to be brought into contact with or separated from the blanket cylinder. The supply of air into the pressure pad brings about a possibility of enhancing the elasticity of the pressure pad. Instead of air, a fluid such as water or oil may be supplied into the pressure pad.

The pressure pad for pressing the cleaning fabric against the blanket cylinder is however required to possess sufficient elasticity and steady shape retention so as to bring the cleaning fabric into stable contact with the blanket cylinder.

Incidentally, the blanket cylinder inevitably has a joint gap extending in the longitudinal direction of the blanket cylinder for drawing a sheet of printing paper in a printing operation. Thus, the blanket cylinder rotating at a high speed generates vibrations and noises when being in contact with the cleaning fabric pressed by the pressure pad to clean the peripheral surface of the blanket cylinder. Accordingly, since the pressure pad cannot withstand the contact stress and vibrations caused by the press contact with the blanket cylinder rotating at a high speed, far from retaining an appropriate shape, the pressure pad, which is merely sustained by air supplied into the inside space thereof, entails problems such as increases in vibrations and noises thus generated and failure to achieve contact of the cleaning fabric with the blanket cylinder. As a result, the performance of removing the unwanted matter such as residual ink from the blanket cylinder and the durability of the pressure pad are remarkably decreased.

Even by using fluid having low viscosity fluid or water in place of the air in the inside space of the pressure pad, the pressure pad entails the same disadvantage as described above. In the case of using water or other fluid, a printing system including the blanket cylinder will suffer a serious disadvantage such that when the pad containing the water is broken due to degradation or other possible causes, the printing system will be adversely effected and printing papers will be stained by the fluid.

As described above, the supplying of air or water into the inside space of the pressure pad produces the effect of somewhat increasing the elasticity of the pressure pad, but never increases the cleaning efficiency and durability of the pressure pad.

The conventional pressure pad which is selectively inflated or deflated by controlling air introduction will be explained in detail with reference to FIG. 2. A blanket cylinder C is wiped up by a cleaning fabric 2 traveling in the direction D2 opposite to the direction Dc in which the cylinder C rotates. A pressure pad 6 is held by a supporting member 8 and has an inside space 6*a* defined by a wall curved in a semi-circular shape. To press the cleaning fabric 2 against the blanket cylinder C, compressed air is introduced into the inside space 6*a* in the pressure pad 6 to expand the pressure pad 6.

The rubber pressure pad 6 is expanded and retained in its shape by the pressure of the air. Nevertheless, the shape retention thereof is insufficient, and what is worse, since the pressure pad 6 is fixed at opposite side edges thereof to the supporting member 8 as shown in FIG. 2, it locally protrudes particularly at its central portion thereof and expands unevenly over the entire surface. As a result, uniform cleaning cannot be fulfilled.

Moreover, when the pressure pad 6 presses the cleaning fabric 2 against the blanket cylinder C during the cleaning operation, a tractive force produced by the cleaning fabric 2 traveling in the direction of D2 acts leftwards upon the pressure pad 6 in FIG. 2. Since the elasticity of the air introduced into the inside space of the pressure pad 6 is insufficient to steadily retain the shape thereof, the pressure pad 6 is deformed or collapsed in the direction D2 in which the cleaning fabric 2 is forwarded, as illustrated, consequently causing unevenness in cleaning.

Incidentally, the state of contact of the cleaning fabric 2 with the blanket cylinder C is usually represented by a nip width (contact area) and a nip pressure (contact pressure). When the pressure pad sustained by the internal pressure for air has been in use of a long period of time, it becomes easy expandable and undergoes a change of the nip conditions, possibly resulting in misalignment and aberration in nip conditions.

As noted above, the conventional blanket cleaning device utilizing the air-filled type pressure pad as noted above is disadvantageous in that the pressure pad is insufficient in shape retention and cannot endure prolonged use and hard conditions for stably cleaning the blanket cylinder rotating at a high speed.

OBJECTS OF THE INVENTION

An object of the present invention is to eliminate the various drawbacks suffered by the conventional cleaning apparatus for a printing press blanket cylinder as mentioned above. A further object of this invention is to provide an apparatus for cleaning a printing press blanket cylinder, which comprises a pressure pad having sufficient viscoelasticity to steadily and uniformly press a cleaning fabric against the rotating blanket cylinder to effectively clean the blanket cylinder.

Another object of this invention is to provide a printing press blanket cylinder cleaning apparatus capable of cleaning the blanket cylinder with a high efficiency without increasing vibrations and noises inevitably generated during the cleaning operation.

Still another object of this invention is to provide a method capable of readily manufacturing a printing press blanket cylinder cleaning apparatus provided with a pressure pad having adequate viscoelasticity to steadily and uniformly press a cleaning fabric against the rotating blanket cylinder to effectively clean the blanket cylinder.

SUMMARY OF THE INVENTION

To attain the objects described above according to this invention, there is provided a printing press blanket cylinder cleaning apparatus comprising a hollow pressure pad retained by a supporting member, and a viscoelastic material filled into the pressure pad.

The pressure pad is formed by curving a rubber plate in the shape of a semi-columnar cylinder or made of a rubber tube so as to possess an inside space for accommodating the viscoelastic material.

As the viscoelastic material, there may be used a gelatinous composition capable of solating with heat, such as polyethylene gel and silicone gel.

The supporting member for the pressure pad is provided with a pouring member for introducing the viscoelastic material into the inside space of the pressure pad. The viscoelastic material of the gelatinous composition is solated with heat when being injected into the pressure pad. After introducing the viscoelastic material into the inside space, the pouring member is sealed.

The hollow pressure pad filled with the viscoelastic material has an adequate viscoelasticity for steadily retaining the shape thereof, so that the cleaning fabric can be stably brought into press contact with the blanket cylinder without causing flopping of the cleaning fabric. As a result, unwanted matter such as residual ink and paper fragments on the blanket cylinder can be effectively removed.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

This invention will become more fully understood from the detailed description given hereinbelow and the accompanying drawings which are given by way of illustration only, and thus are not limitative of the present invention.

Figure 1:
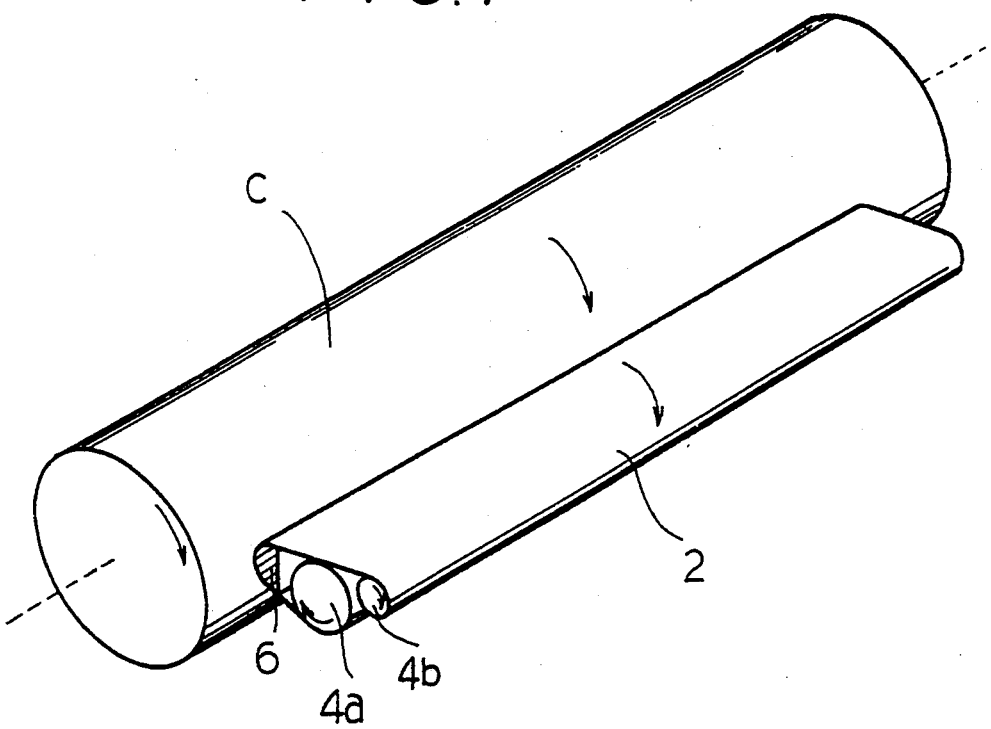
FIG. 1 is a schematic perspective view showing a common blanket cylinder cleaning apparatus.
Figure 2:
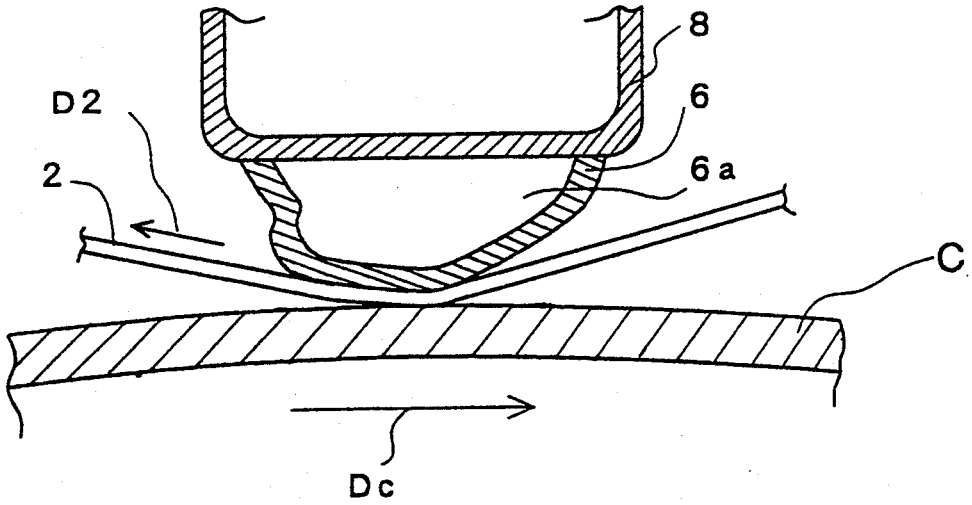
FIG. 2 Prior Art
FIG. 2 is a side cross section conceptually showing the state in which a pressure pad of a conventional blanket cylinder cleaning apparatus comes in contact with a rotating blanket cylinder.

The blanket cylinder cleaning apparatus 10 according to this invention is arranged parallel to the axis of a blanket cylinder C in a printing press, similarly to a common blanket cylinder cleaning apparatus as shown in FIG. 1. This cleaning apparatus 10 has a fabric supply roll 14*a* of a cleaning fabric 12, and a fabric take-up roll 14*b* for taking up the cleaning fabric 12 unwound from the fabric supply roll 14*a*. The cleaning fabric 12 unwound from the fabric supply roll 14*a* is pressed against the outer peripheral surface of the blanket cylinder C by a hollow pressure pad 16 as shown in FIG. 3.

The fabric supply and take-up rolls 14*a* and 14*b* are rotatably held by side plates 15 and driven to rotate by a drive means (not shown).

The pressure pad 16 is made by bending or curving a sheet-like or plate-like elastomeric rubber having a desired strength and thickness into the shape of a semi-columnar cylinder. The pressure pad 16 has flanged edges 16*a* and ribs 16*b*. It is desired to make the pressure pad 16 of rubber or other elastic material having a JIS rubber hardness of less than about 50, preferably, less than about 40.

Figure 3:
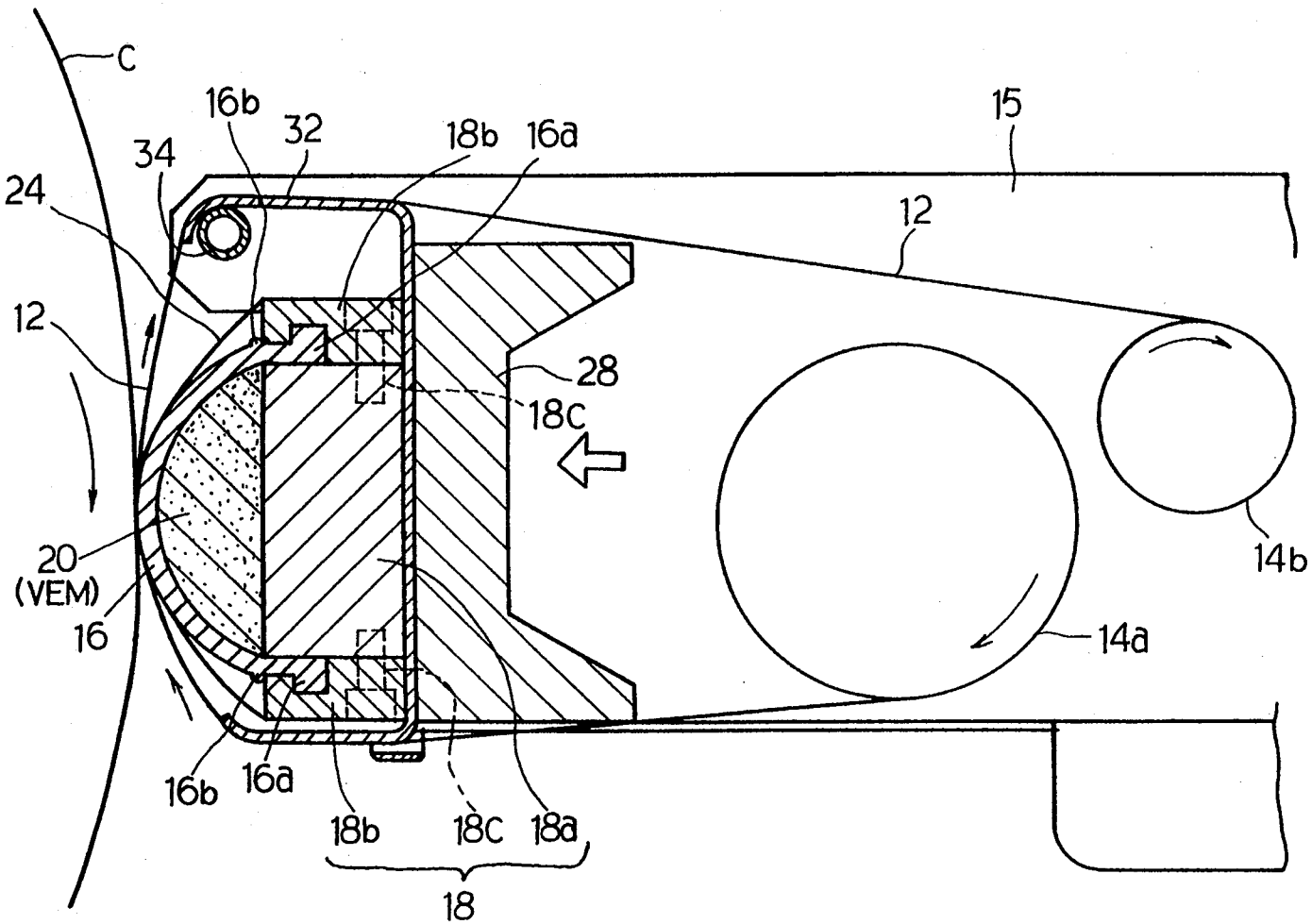
FIG. 3 is a side cross section showing, in part, one embodiment of the blanket cylinder cleaning apparatus of the present invention, having a pressure pad in contact with a blanket cylinder.
Figure 4:
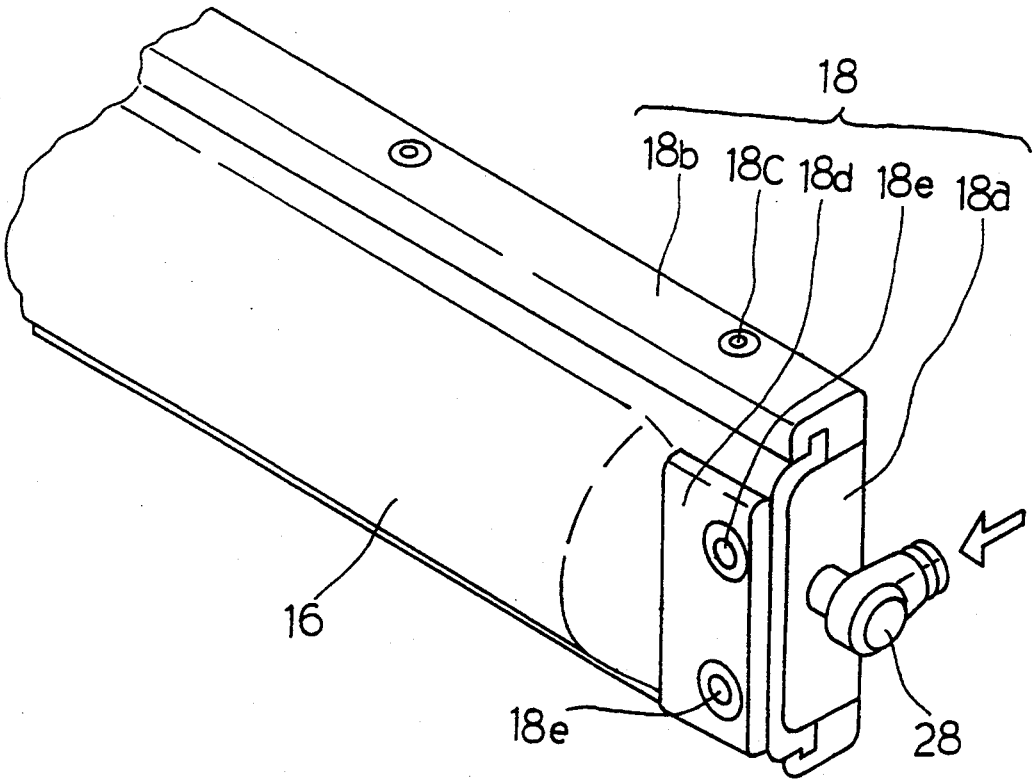
FIG. 4 is a perspective view showing, in part, the pressure pad of this invention.

The pressure pad 16 is steadily held by a supporting member 18 comprising short-side edge retaining means each having a support base 18*a*, a pad holder 18*b* and bolts 18*c* as illustrated in FIG. 3, and longitudinal edge retaining means each having a holder plate 18*d* and bolts 18*e* as shown in FIG. 4. That is, the pressure pad 16 is fixed by fitting the flanged edges 16*a* into grooves formed in the inner wall of the pad holders 18*b* and tightening the bolts 18*c*.

The apparatus further has a shape-retaining sheet 24 secured by the pad holders 18*b* so as to cover the pressure pad 16 therewith. As one example, this shape-retaining sheet 24 may be formed of non-stretchable hard fabric made by coating glass wool with Teflon. However, since this shape-retaining sheet 24 is not necessarily indispensable to the present invention, it may be excluded from the apparatus.

Accordingly, a hermetically enclosed inside space 20 having a semi-columnar cross section is defined between the curved pressure pad 16 and the supporting member 18.

The support base 18*a* of the supporting member 18 has a pouring member 28 through which the viscoelastic material VEM is forcibly introduced into the inside space 20 of the pressure pad 16, consequently to stably retain the pressure pad 16 in its inflated state.

The viscoelastic material may be made by mixing a gelatinous composition capable of solating with heat, i.e. polyethylene gel and silicone gel, with a hardener and a thickener as gellant.

It is desirable to use a viscoelastic material having a C-hardness of less than 8 (SRISO 0101), preferably, less than 4. More concretely, there may be applicable viscoelastic material having tensile strength of more than 7.9 kgf/cm (at tensile speed of 500 mm/min. on JIS K 6301), modulus of elasticity in tension of more than 1300% (at tensile speed of 500 mm/min. on JIS K 6301), tensile stress of 0.1 to 0.2 kgf/cm (at tensile speed of 500 mm/min. and tensile stress of 50% to 400% on JIS K 6301), and rebound hardness of 25% kgf/cm (by free-falling of an iron rod from 100 m above on JIS K 6301).

The cleaning fabric 12 is required to have a sufficient strength for withstanding strong tensile force brought about when being wound up by the fabric take-up roll 14*b*, sufficient wear resistance for withstanding severe chafing due to the high speed rotation of the blanket cylinder, and sufficient absorbency for uniformly and efficiently absorbing a cleaning solution, solvent, water or the like. As the cleaning fabric, non-woven fabric is most desirable. The cleaning fabric 12 traveling from the supply roll 14*a* to the take-up roll 14*b* is tightly guided by a guide member 32 secured by the support base 28 between the side plates 15.

Figure 5:
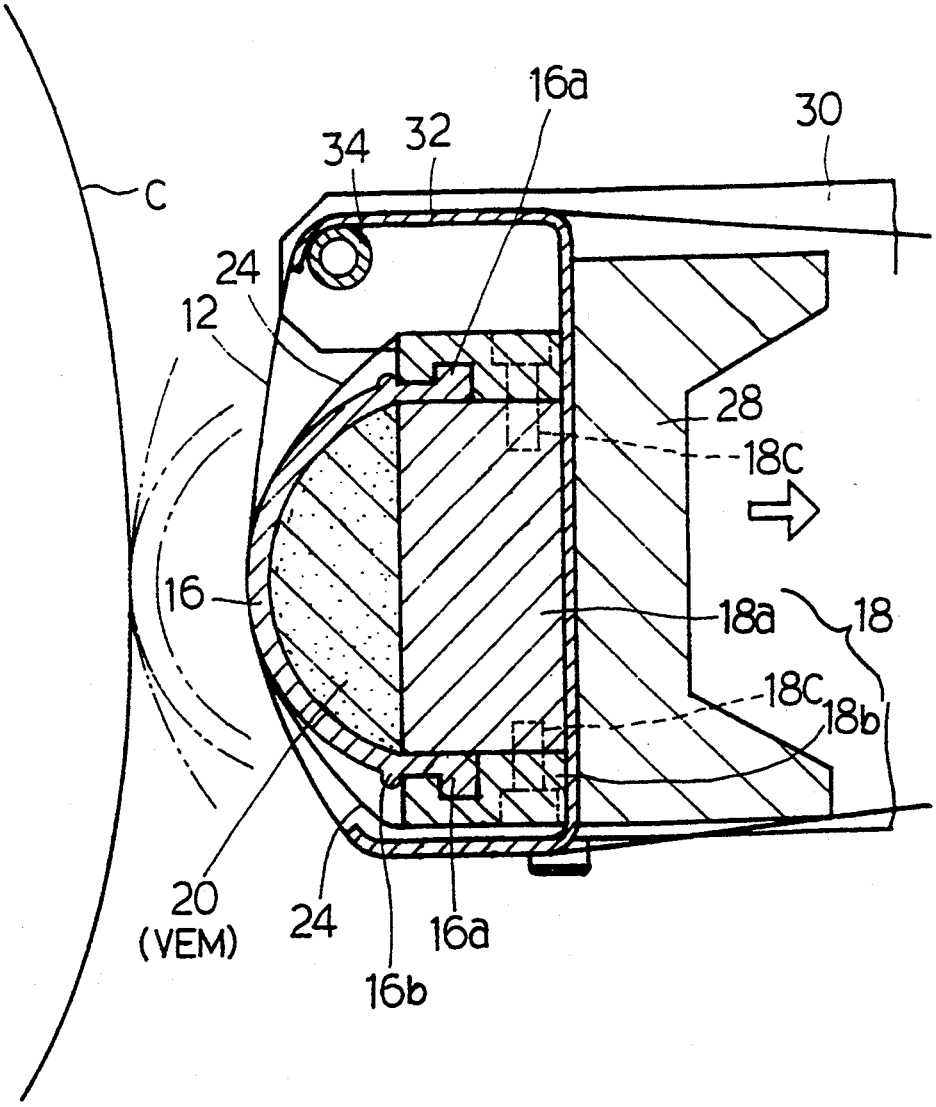
FIG. 5 is a side cross section showing the state in which the pressure pad of this invention is separated from the blanket cylinder.

The cleaning apparatus of this embodiment is provided with a spray nozzle 34 for spraying a cleaning solution toward the blanket cylinder. Since the inflated shape of the pressure pad 16 is steadily maintained by the viscoelastic material VEM filled into the inside space thereof at all times, the pressure pad 16 is driven movably forward and backward relative to the blanket cylinder C by means of a not-shown drive means including a plunger, motor and gears. That is, the pressure pad 16 can selectively assume either a position in press contact with the blanket cylinder C as shown in FIG. 3, or a position separated from the blanket cylinder C as shown in FIG. 5.

As stated above, the pressure pad 16 of this invention can steadily press the cleaning fabric 2 against the blanket cylinder C with the desired nip width (contact area) while maintaining its suitably inflated shape.

Next, a method for producing the pressure pad 16 according to this invention will be described.

As one example of the viscoelastic material VEM to be filled into the inside space of the pressure pad 16, polyethylene gel is used and heated in advance at about 110° C. to 160°C., preferably 120° C. to 150° C. to be subjected to solation. The solated viscoelastic material having fluidity is injected into the inside space 20 defined between the pressure pad 16 and the support base 18*a* through the pouring member 28. The viscoelastic material VEM is forcibly introduced into the inside space 20 at about 0.4 to 0.5 kg/cm pressure by use of a plunger pump until the pressure pad 16 is inflated to a semi-columnar shape like a barrel. Since the viscoelastic material solated with heat is somewhat decreased in volume when cooled, the amount of the viscoelastic material to be injected into the inside space may be predetermined in expectation of such decrease in volume of the viscoelastic material.

When the viscoelastic material VEM is cooled after being injected into the inside space 20 of the pressure pad 16, it changes from its solated state to its gelatinous state and becomes solid in thorough conformity with the configuration of the inside space.

Although the viscoelastic material is injected into the inside space 20 through the pouring member 28, an opening may be bored in a holder plate 18*d* to lead the viscoelastic material into the inside space of the pad. For the purpose of leaking remaining air in the inside space 20 therefrom when injecting the viscoelastic material, an air vent hole may be formed, though not shown.

According to the pressure pad 16 of the present invention, vibrations and noises produced in cleaning the blanket cylinder can be remarkably reduced owing to the excellent cushioning effect of the viscoelastic material. This cushioning effect becomes conspicuous when the blanket cylinder C, pressure pad 16 and viscoelastic material VEM have the following relation in hardness:

$$Hc > Hp > Hm \ldots \quad (1)$$

wherein,

Hc: Surface hardness of Cylinder C (about 60),

Hp: Hardness of Pressure Pad 16 (about 40), and

Hm: Hardness of VEM (about 4).

In this relation among the cylinder C, pad 16 and VEM, the vibrations and noises produced by bringing the pressure pad 16 into contact with the blanket cylinder C rotating at a high speed are transmitted deep into the viscoelastic material VEM and effectively damped there.

To prove the excellent cushioning effect of the pressure pad accommodating the viscoelastic material, a comparative experiment was made by using the VEM-filled pressure pad of this invention and a conventional air-filled pressure pad. The experiment was conducted by attaching the cleaning apparatuses provided with the VEM-filled pressure pad of this invention and the conventional air-filled pressure pad to a blanket cylinder of an offset rotary printing press. The cleaning apparatuses each were provided with vibration sensors for detecting three-dimensional vibrations generated in the radial or centripetal direction of the pad in which the pressure pad moves forward and backward relative to the blanket cylinder (X-direction), the longitudinal direction of the pressure pad (Y-direction), and the direction tangential to the blanket cylinder (Z-direction). Vibrations were measured in the operative state of the pressure pad (L1), in which the pad is pressed against the cylinder to clean the cylinder, and the inoperative state of the pressure pad (L2), in which the pad is separated from the cylinder, to obtain differences in vibration between L1 and L2.

Results of such experiment were that there were recognized little difference in vibration in the X-direction, a slight difference in the Y-direction, and a large difference in the Z-direction. For example, the difference in acceleration of the vibrations generated in the Z-direction in the conventional cleaning apparatus having the air-filled pressure pad was 21 dB (L1-L2=96-75), and that in the present apparatus having the VEM-filled pressure pad was 17.8 dB (L1-L2=93.6-75.8). Thus, difference as much as 3.2 dB could be recognized between the conventional apparatus and the present apparatus. Furthermore, it was confirmed experimentally that the viscoelastic material VEM used in the present invention is large in vibrational damping factor, and particularly, can fulfill an excellent function of attenuating vibrations in the high frequency range.

In addition, a noise-level measuring test was performed with the VEM-filled pressure pad of this invention and the conventional air-filled pressure pad as noted above. The test was conducted by placing a noise measuring microphone 10 cm away from the central portion of the blanket cylinder. The noises generated in the operative state of the pressure pad (L1), in which the pad is pressed against the cylinder to clean the cylinder, and the inoperative state of the pressure pad (L2), in which the pad is separated from the cylinder, to obtain differences in noises between L1 and L2 were measured.

The noises generated in the conventional cleaning apparatus having the conventional air-filled pressure pad were changed from 70 dB in the L2 state to 91.6 dB (maximum) in the L1 state. On the other hand, mere difference in noise of about 10 dB between 70 dB in the L2 state and 80.8 dB in the L1 state (maximum) was confirmed when using the VEM-filled pressure pad of the present invention.

Although the foregoing embodiment employs the pressure pad shaped in a semi-columnar cylinder, this shape is by no means limitative and the pressure pad may have any other desired shape such as a cylinder or tube.

Figure 6:
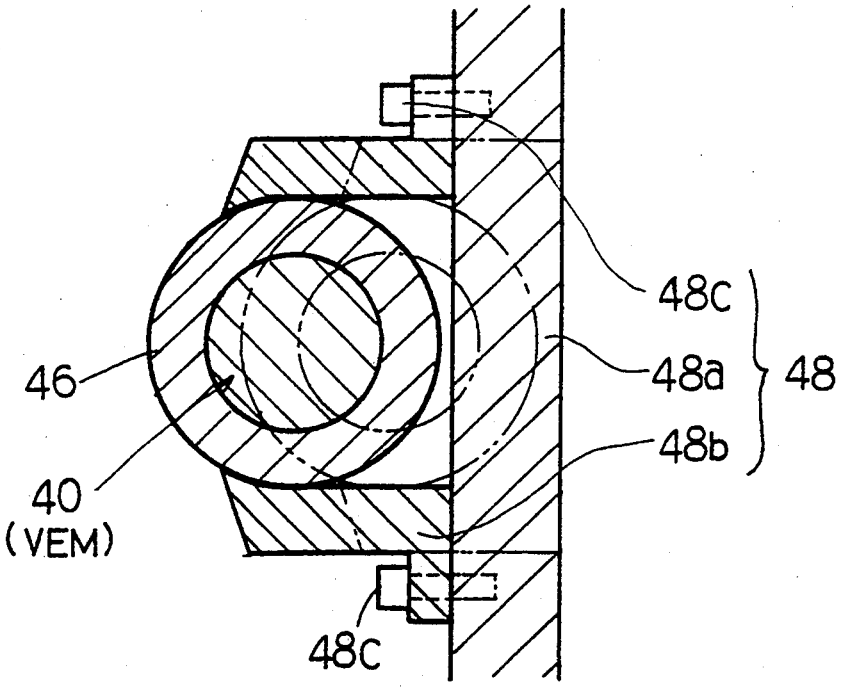
FIG. 6 is a side cross section of another embodiment of this invention.

As illustrated in FIG. 6 by way of example, a tube-like pressure pad 46 having a cylindrical inside space 40 may be used. By filling the inside space 40 of the pressure pad 46 with the viscoelastic material VEM as described above, the same desired effect as that of the foregoing embodiment can be obtained. The pressure pad 46 is secured by a supporting member 48 comprising a support base 48*a*, pad holders 48*b*, and bolts 48*c*. The pressure pad 46 of this embodiment is also movable forward and backward relative to the blanket cylinder, as indicated by imaginary lines in FIG. 6.

Although the cleaning apparatus according to the present invention is applied to the printing press blanket cylinder as described above, it is of course applicable to various devices similar to the printing press such as a papermaking machine for removing unwanted matter.

As is apparent from the foregoing description, since the blanket cylinder cleaning apparatus of this invention has a pressure pad having adequate viscoelasticity to properly and uniformly press the cleaning fabric against the rotating blanket cylinder, the cleaning fabric can be steadily pressed against the blanket cylinder rotating at a high speed to effectively clean the blanket cylinder without increasing vibrations and noises involved in cleaning.

As can be readily appreciated, it is possible to deviate from the above embodiments of the present invention and, as will be readily understood by those skilled in this art, the invention is capable of many modifications and improvements within the scope and spirit thereof. Accordingly, it will be understood that the invention is not to be limited by these specific embodiments, but only by the scope and spirit of the appended claims.

What is claimed is:

1. An apparatus for cleaning a blanket cylinder in a printing press, said apparatus comprising a pressure pad having an inside space, a supporting member supporting said pressure pad for movement forward and backward relative to the blanket cylinder, and a viscoelastic material filled into said inside space of said pressure pad.

2. An apparatus according to claim 1, wherein said viscoelastic material is a gelatinous composition capable of solating with heat.

3. An apparatus according to claim 1, wherein said viscoelastic material is made by mixing polyethylene gel with a hardener and a thickener.

4. An apparatus according to claim 1, wherein said viscoelastic material is made by mixing silicone gel with a hardener and a thickener.

5. An apparatus according to claim 1, wherein said pressure pad is made by curving a sheet-like or plate-like elastomeric rubber member in the shape of a semi-columnar cylinder.

6. An apparatus according to claim 1, wherein said pressure pad has flanged edges secured by said supporting member to steadily hold said pressure pad and hermetically enclose said inside space having a semi-columnar cross section between said pressure pad and said supporting member.

7. An apparatus according to claim 1, wherein said supporting member has a pouring member through which said viscoelastic material is introduced into said inside space of said pressure pad.

8. An apparatus according to claim 1, further comprising a shape-retaining sheet secured by said supporting member and covering said pressure pad.

9. An apparatus according to claim 8, wherein said shape-retaining sheet is formed of non-stretchable hard fabric made by coating glass wool with Teflon.

10. An apparatus according to claim 1, wherein said pressure pad is shaped as a tube having a cylindrical inside space.

11. An apparatus according to claim 1, further comprising a fabric supply roll for supplying cleaning fabric, and a fabric take-up roll for taking up cleaning fabric unwound from said fabric supply roll and to press said cleaning fabric unwound from said fabric supply roll against the blanket cylinder.

12. An apparatus according to claim 1, wherein said supporting member comprises side retaining means each having a support base, a pad holder, and bolts, and longitudinal end retaining means each having a holder plate and bolts.

13. A method for producing a blanket cylinder cleaning apparatus, said method comprising providing a pressure pad with an inside space, heating a gelatinous viscoelastic material to solate said material, and introducing said viscoelastic material thus solated into said inside space of said pressure pad.

14. A method according to claim 13, wherein said viscoelastic material is polyethylene gel and is heated at about 110° C. to 160° C. to be subjected to solation before being introduced into said inside space.

* * * * *